US006431858B1

(12) United States Patent
Rutz

(10) Patent No.: US 6,431,858 B1
(45) Date of Patent: Aug. 13, 2002

(54) METHOD AND ARRANGEMENT FOR SUPPORTING A WEB AND AVOIDING AIR LOSSES IN A HEAT TREATING APPARATUS

(75) Inventor: Andreas Rutz, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/783,890

(22) Filed: Feb. 14, 2001

(30) Foreign Application Priority Data

Feb. 16, 2000 (DE) ..... 100 07 004

(51) Int. Cl.[7] ..... F27B 9/28
(52) U.S. Cl. ..... 432/59; 432/8; 34/641
(58) Field of Search ..... 432/8, 59; 34/641

(56) References Cited

U.S. PATENT DOCUMENTS

| | | | | |
|---|---|---|---|---|
| 3,559,301 A | | 2/1971 | Fraser | |
| 3,587,177 A | * | 6/1971 | Overly | 34/641 |
| 4,074,841 A | * | 2/1978 | Kramer et al. | 34/641 |
| 4,575,952 A | | 3/1986 | Bodenan et al. | |
| 4,591,517 A | | 5/1986 | Whipple et al. | |
| 4,932,140 A | * | 6/1990 | Lepisto | 34/641 |
| 5,014,447 A | * | 5/1991 | Hagen | 34/641 |

FOREIGN PATENT DOCUMENTS

| | | |
|---|---|---|
| DE | 1299667 | 7/1969 |
| DE | 1938529 | 1/1970 |
| DE | 1729274 | 6/1971 |
| DE | 1729490 | 6/1971 |
| DE | 3140935 | 5/1983 |
| DE | 3501684 | 7/1986 |
| EP | 0196107 | 10/1986 |
| EP | 0721095 | 7/1996 |
| EP | 0770731 | 5/1997 |
| FR | 2392818 | 12/1978 |
| WO | WO95/14199 | 5/1995 |

* cited by examiner

*Primary Examiner*—Jiping Lu
(74) *Attorney, Agent, or Firm*—W. F. Fasse; W. G. Fasse

(57) ABSTRACT

In an apparatus for heat treating a material web that enters and exits the apparatus through respective gaps, an air cushion generating unit includes a slot nozzle through which a ventilator blows a laminar flow of air, which then flows laminarly along a convexly curved surface of the unit, to form a laminar air cushion which flows directly along the material web through one of the gaps, then expands outside of this gap, and is sucked back into the air cushion generating unit and recirculated through the slot nozzle. The laminar air cushion steadily holds and supports the material web so that the mechanical gap size can be reduced while reducing losses of hot process air and still avoiding physical contact with the material web.

29 Claims, 2 Drawing Sheets

METHOD AND ARRANGEMENT FOR SUPPORTING A WEB AND AVOIDING AIR LOSSES IN A HEAT TREATING APPARATUS

PRIORITY CLAIM

This application is based on and claims the priority under 35 U.S.C. §119 of German Patent Application 100 07 004.3, filed on Feb. 16, 2000, the entire disclosure of which is incorporated herein by reference.

FIELD OF THE INVENTION

The invention relates to a method for stably guiding and supporting a web of goods, and preferably a non-air-permeable or air-tight material web such as a thermoplastic web that can be stretched to form a film, between the inlet or entrance gap and the outlet or exit gap of a heat treating apparatus. The invention further relates to an arrangement that forms the entrance and exit gaps of a heat treating apparatus, so as to reduce air losses therethrough.

BACKGROUND INFORMATION

Various thermal treatment processes are known, in which a web of goods, such as a thermoplastic web that may be expanded or stretched to form a thermoplastic film, is guided through a heat treating apparatus. The-web enters the apparatus through an inlet or entrance gap, and leaves the apparatus through an outlet or exit gap. The inflow of cold outside air and the outflow of heated process air through the entrance gap and the exit gap cause undesirable energy losses from the apparatus and from the heat treating process. Additional energy must be supplied to the apparatus and the process in order to make up for the lost heat energy.

The extent of this energy loss is essentially dependent on the vertical size of the entrance gap and the exit gap, and the transport velocity with which the material web travels through the heat treating apparatus. The energy losses are further dependent on the prevailing pressure difference between the interior space of the heat treating apparatus and the atmospheric environment outside of the heat treating apparatus. In other words, the positive pressure that is typically developed inside the heat treating apparatus will constantly seek a compensating path to the lower atmospheric pressure outside of the heat treating apparatus, so that hot process air will constantly flow out of the apparatus through the entrance and exit gaps. It is further understandable that the energy losses increase with the size of the entrance and exit gaps, as well as with an increasing web transport speed. The crosswise width of the entrance and exit gaps is determined by the width of the material web to be processed or to be achieved, so that it is conceptually not possible to reduce or limit this width of the gaps, and the present specification will not further discuss the energy losses resulting therefrom.

The height or the vertical size of the entrance and exit gaps can be influenced or adjusted, and thereby the energy losses may be reduced, as is known from a variety of prior art solutions in this context. For example, it is known to carry out a corresponding control or regulation of the pressure within the heat treating apparatus. As an example, by maintaining a slight under-pressure or negative pressure inside the heat treating apparatus relative to its surrounding environment, energy losses arising from the above mentioned static pressure difference can be avoided. In such a case, however, it is disadvantageous that the surrounding atmospheric air, which is much colder than the temperature of the hot process air within the apparatus, is constantly sucked into the heat treating apparatus through the entrance and exit gaps due to the reduced pressure inside the apparatus.

The quantity of air that is sucked into the apparatus.must then correspondingly be removed from the apparatus in a precisely controlled manner, in order to maintain the intended reduced or negative pressure level within the heat treating apparatus. Simultaneously, additional energy must be introduced, in order to heat the in-flowing, relatively cold surrounding atmospheric air to a temperature level that is sufficiently high so as not to interfere with the heat treating process being carried out within the heat treating apparatus. At the typical high temperatures, for example approximately 240° C. for treating a polyester film, the required continuous supply of additional energy can lead to a considerable energy consumption and increased cost of the process.

The dynamic energy losses that arise due to the quantities of air being carried or pulled along with the web of goods out of the heat treating apparatus at the transport speed of the web cannot be avoided by the above described measure of establishing a reduced or negative pressure within the treating chamber. Instead, other means are necessary to avoid or reduce this type of as energy loss. One possibility is to make the entrance and exit gaps as narrow as possible. To achieve this, for example, partitions or bulkhead members are arranged above and below the material web across the entire width of the heat treating apparatus, along the upper and lower portions of the entrance and exit gaps. Such partition or bulkhead members can be embodied as hanging metal plates or flap doors with a great variety of configurations. In any event, these partition or bulkhead members reduce the vertical height of the open gap.

Such measures are only effective, however, as long as the material web remains stably supported on the intended web transport plane. In this regard, very wide webs and particularly such webs of heavy, limp or slack materials, will hang and bow downward. On the other hand, webs of very thin or delicate materials, which cannot be adequately tensioned, will flutter or billow up and thus away from the intended web transport plane. Webs of material with such characteristics thus come into direct contact with the above described partition or bulkhead members along the entrance or exit gaps. This direct physical contact can cause damage or even tearing of the material web. Thereupon, such a damaged or torn material web leads to a stop or interruption of the heat treating process, which in turn triggers various undesired results, and particularly a slow down or loss of production output, and increased costs.

Another possibility of reducing energy losses is the use of an air curtain or air sluice. In this context, a vigorous air stream is directed in the form of an air curtain substantially perpendicularly against the material web, above and below the material web at the entrance gap and the outlet gap, in order to thereby form a barrier that is intended to block the inflow or outflow of air past or through this air curtain. A disadvantage of such air curtains is that the additional quantities of air that are used for forming the blocking air curtains must again be removed from the heat treating apparatus, insofar as they are sucked into the apparatus. Also, the air curtains directed substantially perpendicularly against the material web do not support the web, but instead are rather difficult to control in order to avoid a billowing or fluttering of the material web.

For the above reasons, there must be a sufficiently large spacing distance between the material web and the nozzles that are necessary for establishing the air curtain. A physical contact between the material web and the nozzles must absolutely be avoided. This in turn requires a sufficiently high air flow velocity and a sufficiently high air flow volume in order to form an effective air curtain spanning this relatively large spacing distance and still achieving an effective blocking or separation of an airflow through the respective gap. As a result, disadvantageous turbulences arise directly in or along the web plane, which can lead to fluttering or billowing of the material web. Such an unsteady travel of the material web is especially disadvantageous for the process reliability when rather sensitive material webs are being treated.

SUMMARY OF THE INVENTION

In view of the above, it is an object of the invention to provide appropriate measures at the entrance and exit gaps of a material web heat treating apparatus, to minimize the loss of energy in the form of hot air out through the entrance and exit gaps, while essentially completely avoiding physical contact between the material web and the mechanical gap-closing components. The invention aims to avoid mechanical rolls for supporting and guiding the material web near the entrance and exit gaps. The invention further aims to avoid or overcome the disadvantages of the prior art, and to achieve additional advantages, as apparent from the present specification.

The above objects have been achieved according to the invention in a method of stably guiding a material web, such as a thermoplastic material web that can be expanded or stretched to form a thermoplastic film, which is subjected to a heat treatment in a heat treating apparatus. According to the invention, the material web is transported into the heat treating apparatus through an entrance gap, is heat treated in the apparatus, and is then transported out of the apparatus through an exit gap. Proximate to at least one of the gaps, the invention further applies a force to the material web within the heat treating chamber, so as to positively hold the material web in a defined horizontal plane over at least a prescribed length or range ahead of and behind the respective gap.

Especially according to the invention, the above mentioned force is provided by a laminar air flow that forms an air cushion which holds or supports the material web directly in the respective gap, and then expands outside of the respective gap, where the resulting expanded air is sucked back into the heat treating apparatus, or particularly a special air cushion generator unit within the heat treating apparatus. The most important feature of the method according to the invention is that a laminar air flow is generated at least between the bottom surface of the material web and the lower gap boundary of at least the entry gap or the exit gap in the heat treating apparatus. This laminar air flow develops an air cushion between the material web and the device that guides or generates the laminar air flow. This resulting air cushion is maintained over at least a prescribed length or distance range before and after the respective gap of the heat treating apparatus. Preferably, such air cushions are provided at both the entrance gap and the exit gap. The air cushion then expands outside of the respective gap, i.e. down-stream of the exit gap or upstream of the entrance gap, and the resulting expanded air is sucked back into the heat treating chamber or especially into a suitable air cushion generating unit within the heat treating apparatus.

According to further embodiment details of the inventive method, the air flow that forms the air cushion is directed to flow at a prescribed acute angle, e.g. not greater than 30° and preferably not greater than 20°, and especially parallel and tangential relative to the material web plane. The air cushion is formed continuously crosswise relative to the transport direction and entirely across the width of the material web. The phrase "entirely across the width" of the material web or the gap is intended to also cover the situation in which the air cushion does not extend across 100% of the physical maximum width of the gap, but leaves an insignificant portion of the width of the gap, e.g. at the ends or edges of the air cushion, without having any significant influence on the functionality. As a further feature of the invention, the parameters determining the characteristics of the air cushion are continuously adjustable in a stepless manner and the thickness and height of the air cushion serves to minimize the opening size of the respective entrance or exit gap.

More particularly, the air cushion is formed by blowing the laminar air flow along the contoured profile surface of an air guide member located opposite and facing the material web, whereby this profile surface has an outwardly curved convex contour, similar to the contour of the upper surface of an aircraft lifting wing. This profile surface guides the air flow in such a manner so that it cannot deviate or separate from the side or surface facing the material web. Thus, this air flow causes a Coanda effect between the respective facing surface of the material web and the contoured surface of the profiled air guide member.

While the respective surface of the material web facing the air guide member is especially the bottom surface of the web, i.e. the air cushion is especially provided below the material web, it is additionally or alternatively possible to provide an air cushion according to the invention above the material web. In any event, due to the relatively high air flow velocity of the air flowing along the surface of the curved or contoured profile member, a negative or reduced pressure develops relative to the opposite facing surface of the material web, much like the negative pressure and lift developed on the upper surface of an aircraft wing. Due to this reduced pressure between the material web and the contoured profile surface, the material web is pulled in a direction toward this contoured surface. Thereby, the material web is steadily held and supported relative to the air blowing slot nozzle or particularly the curved contour of the profile member. This holding effect is achieved regardless whether the inventive air cushion is formed above or below the material web. The positive holding effect on the material web is particularly steady and well defined, because the material web must remain a sufficient spacing distance away from the nozzle arrangement and particularly the air guide surface thereof to allow the laminar cushion of air to exit between the material web and the air guide surface. In other words, on the one hand the material web is pulled or sucked toward the air guide surface, and on the other hand the material web is held away from the air guide surface by the interposed air cushion.

The above objects have further been achieved according to the invention in a heat treating apparatus for heat treating material webs, such as thermoplastic material webs that can be expanded or stretched to form thermoplastic films. The heat treating apparatus includes an entrance gap entering into a heat treating chamber enclosed in a housing of the apparatus, and an exit gap exiting out of the heat treating chamber. Respective gap covering components that are movably adjustable, are arranged above and below the web transport plane in both the entrance gap and the exit gap. According to the invention, at least one of the gap covering components, and preferably the gap covering component below the web transport plane, comprises a substantially box-like air cushion generating structural unit that extends entirely across the width of the material web. The term "substantially box-like" is intended to define a shape that encloses an interior volume therein, and is especially (preferably) substantially rectangular, except for a surface thereof that lies across from or faces the material web plane, which surface has an outwardly curved convex contour, generally similar to the contour of the upper surface of an aircraft wing.

Furthermore, this air guide surface forms an air outlet slot in the manner of a slot nozzle that is directed generally transversely and particularly smoothly tangentially to the material web transport plane. This surface is curved and arranged in such a manner so that it gradually tapers the spacing distance between the material web transport plane and this surface in a direction toward the respective entrance or exit gap to a prescribed minimum gap distance. On the inflow side and the outflow side of the treating apparatus, this surface of the air cushion generator structural unit extends across the width of the entrance gap and the exit gap defined by the location of the upper gap covering or closing member. The air guide surface thus extends across and to both sides of the vertical gap plane at the narrowest portion of the respective entrance or exit gap.

It is significant in the inventive apparatus, that the laminar air flow is formed by guiding an air flow through an air outlet slot nozzle along the above mentioned air guide surface contour of the air cushion generating structural unit. This is achieved by the structural unit, in that the first air guide surface of a first air guide sheet or plate member of the structural unit is overlapped by a second air guide sheet or plate member of the structural unit, so as to form the above mentioned slot nozzle therebetween. With such an arrangement, the air flowing between the two air guide sheet or plate members and then exiting from the corresponding slot nozzle flows further along the surface of the first air guide surface and thereby forms an air cushion between this surface and the facing surface of the material web. A separation of the laminar air flow from the guide surface will not occur, because no obstructions exist between the flow surface of the structural unit and the facing surface of the web.

Depending on and responsive to the position of the air outlet slot nozzle and the first air guide plate member, as well as the flow velocity of the airflow being ejected from the airflow slot nozzle, the material web is advantageously held in a constant manner at a pre-defined spacing distance between the upper gap cover member and the first air guide surface of the structural unit, due to the balancing or counteracting effects of the prevailing negative pressure and the air cushion between the first air guide surface and the material web as described above. Thus, any fluttering, billowing, bulging, or sagging of the material web will be prevented in the area of the entrance gap and of the exit gap. As a result, it is advantageously possible according to the invention to position the upper gap covering member very close to the material web plane, without having to fear a contact and resulting damage of the material web.

According to further embodiment details of the invention, the structural unit is separated into a pressure chamber and a suction chamber, i.e. a positive pressure chamber and a negative pressure chamber. The outwardly directed wall of the negative pressure or suction chamber has a plurality of suction openings adjacent to the area in which the air cushion will expand outside of the respective gap. An air line, such as a hose, duct, conduit, pipe, air channel, or the like, is connected between the positive pressure chamber and the negative pressure or suction chamber, with a ventilator, such as a blower, fan, air pump, compressor or the like interposed therein, in order to move the air flow between the two chambers, so as to create the positive pressure in the pressure chamber and the negative pressure in the suction chamber. From the positive pressure chamber, the air then flows out through the above described slot nozzle. The air flow velocity and volume can be regulated by regulating the rotational speed of the above mentioned ventilator, in so far as a separate air supply or air circulation for the air cushion is provided, and insofar as the ventilator has an adjustable operating speed. If such a rotational speed regulation or control is not provided, then the air flow speed and volume can be adjusted by throttling the suction flow or the pressure flow of the ventilator using any conventionally known and suitable air flow regulating device, such as any type of air valve, and particularly a sliding gate valve, for example.

The structural unit is arranged and supported in the apparatus so as to be adjustable at least in a direction perpendicular to the material web plane. Thereby, the thickness of the air cushion can be defined or prescribed, and additionally, the entire structural unit can be moved away from the material web plane in the event of operation interruptions of the apparatus, in order to avoid damage of the material web caused by the structural unit itself. The structural position of the slot nozzle is freely selectable, and can be adjusted as needed to achieve the required air cushion effect in connection with the particular type of material web being treated.

Due to the above described dynamic effects that are achieved when forming the air cushion according to the invention, it is possible to arrange the structural unit above as well as or instead of below the material web plane. Preferably, the structural unit is only arranged below the material web, because in such an arrangement the structural unit can easily be retracted away from the material web in the event of an operation interruption of the apparatus, without requiring significant additional external energy, i.e. simply due to the weight or gravitational mass of the unit.

The top of each gap, i.e. the area of the gap above the material web plane, can be substantially covered by a gap boundary or gap covering member in the form of a pivotable flap door, which simply hangs down into a stable equilibrium position, again due to its own weight, without requiring any additional positioning energy, in normal operation. In order to open this gap covering flap door, various mechanisms can be used, such as levers, tension cables, or the like, as would be recognized by a person of ordinary skill in the art, in order to achieve the required pivoting motion. The operation thereof can be achieved manually, hydraulically, electrically, etc. Preferably, the pivoting mechanism includes a free play range, especially in the direction of the web travel from the neutral downward position, so that the flap door may freely "give" or yield by swinging in the web travel direction in the event of any arising shocks or impacts in this context.

In order not to interfere with or upset the air balance within the heat treating apparatus and possibly also the surrounding environment, while creating the required negative pressure and the air cushion as described above by flowing the required air volumes through the slot nozzle and along the curved contour of the structural unit, it is further provided that this air flow can again be sucked away in the rearward part of the treating apparatus, namely in the area after the air has exited from the gap between the material web and the deflector surface. In this manner, a substantially closed continuous loop air circulation is achieved, which is completely independent of the process air within the heat treating apparatus. The term "substantially closed continuous loop" does not require 100% recirculation of the air cushion air. Instead, it is intended to define the air recirculation loop in which some of the air of the air cushion is lost outside of the apparatus, and some external environmental air is sucked in to replace the lost air cushion air. The key point is that no significant amount of the hot process air within the heat treating chamber is involved in forming the air cushion. The suction or sucking of the return air is carried out in such a manner so that it does not interfere with the actual function of the heat treating apparatus so that it is reliable and secure in its operation. Particularly, the air of the air cushion, after it expands outside of the gap, is sucked back into the air cushion generator unit through a perforated suction surface that is substantially perpendicular to the material web plane. With such an arrangement, the suction area cannot be plugged or blocked by relatively small particles of the material web or other contaminants or soiling which might rise, and which would otherwise interfere with the proper operation of the entire system.

BRIEF DESCRIPTION OF THE DRAWING

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 1:
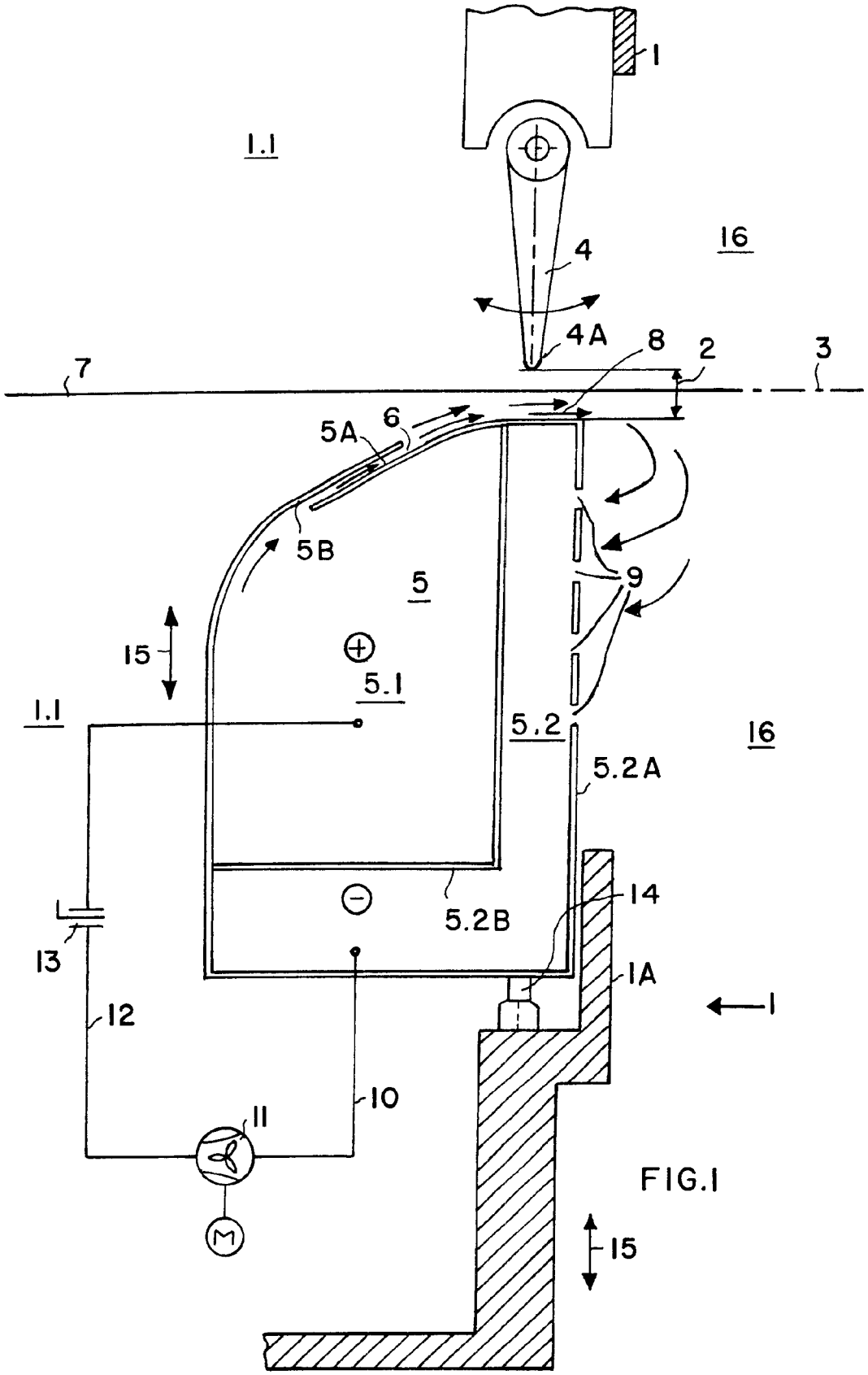
FIG. 1 schematically shows a cross-section of a portion of a heat treating apparatus near the exit gap thereof, with an air cushion generating structural unit according to the invention.
Figure 2:
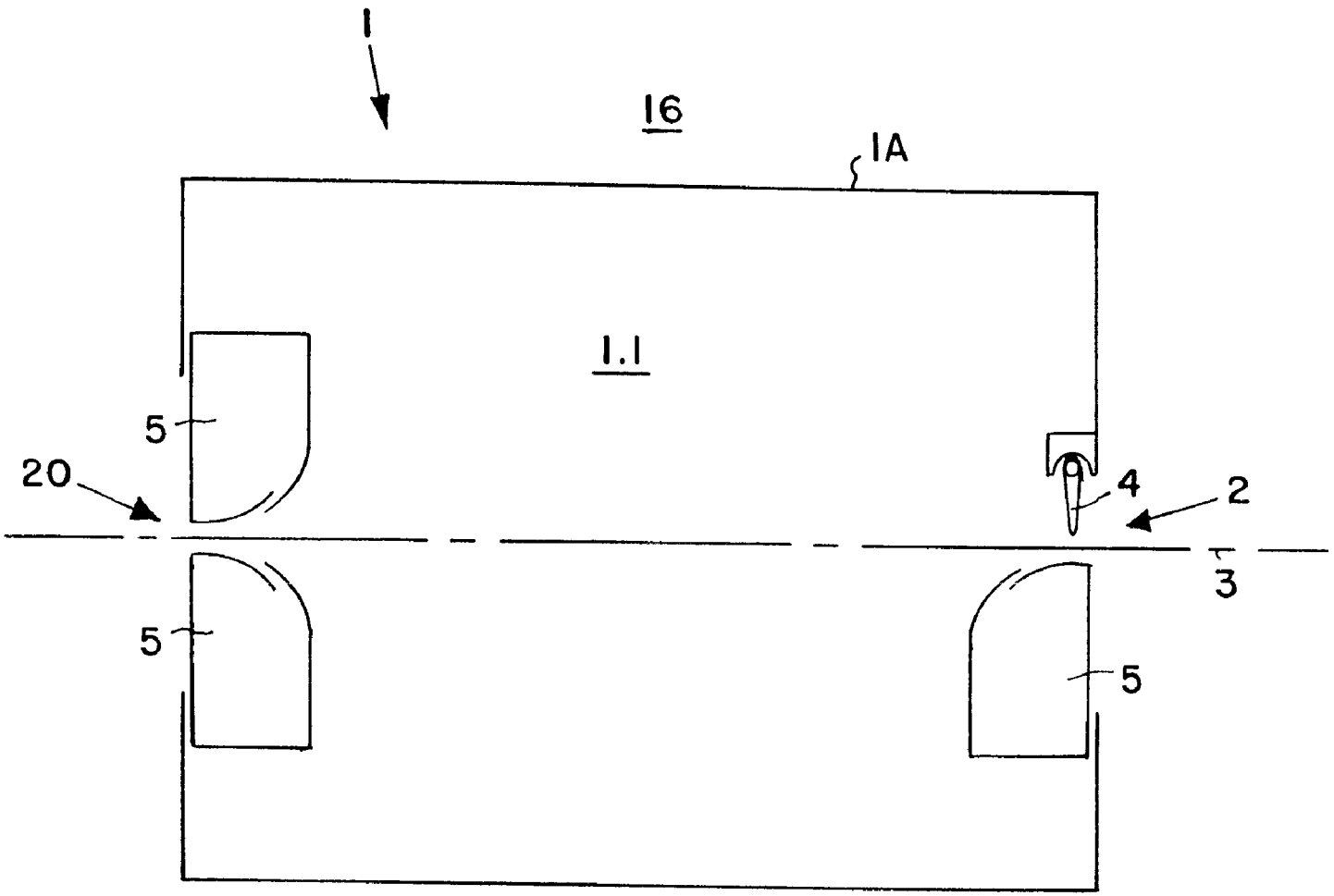
FIG. 2 is a schematic cross-section of a heat treating apparatus with plural air cushion generating structural units arranged therein.

The overall heat treating apparatus 1 schematically shown in FIG. 2, of which only the exit portion is shown in FIG. 1, can have any conventionally known structure and particular components. The heat treating apparatus 1 includes a housing 1A that encloses an interior treatment chamber 1.1, and is surrounded by an outside surrounding environment 16. A material web 7 is to be transported through the heat treating apparatus 1 along a substantially horizontal web transport plane 3, and enters the heat treating apparatus 1 through an inlet or entrance gap 20 (shown in FIG. 2), and exits from the heat treating apparatus 1 through an outlet or exit gap 2. The exit gap 2, with the web transport plane 3 extending substantially through the middle thereof, is bounded between the free edge 4A of a pivotally suspended upper gap boundary in the form of a flap door 4 above the plane 3, and an air cushion generating structural unit 5 (and particularly a portion of a first air guide plate member 5A of the unit 5 extending substantially parallel to the transport plane 3) below the plane 3. As schematically indicated in FIG. 2, there may be such air cushion generating structural units 5 respectively arranged at both the entrance gap 20 and the exit gap 2, and respectively above as well as below the gap.

The air cushion generating structural unit 5 is generally embodied in the form of a box which extends across the entire width of the material web 7 that is to be produced, just like the upper gap boundary flap door 4, thereby defining the gap 2 therebetween. The detailed structure of the structural unit 5 will now be described especially in connection with FIG. 1. A first air guide plate member 5A (preferably a metal sheet or plate) of the structural unit 5 forms the air guide surface of the structural unit that lies opposite the lower surface of the material web 7 or the web transport plane 3. This air guide plate member 5A has an outwardly curved contour (i.e. a convex contour toward the web transport plane 3), generally in the manner of the upper surface of an aircraft lifting wing. The structural unit 5 includes a second air guide plate member 5B that overlaps the lower portion of the first air guide plate member 5A, while being spaced apart therefrom at a defined spacing so as to form an air outlet slot nozzle 6 therebetween.

In this arrangement, the outer contour of the first air guide plate member 5A curves toward the web transport plane 3 so as to taper or narrow the spacing distance between this surface and the web transport plane 3 in the manner.of a narrowing throat, to a minimum gap spacing directly at the center plane of the gap as defined by the upper gap boundary flap door 4. Thereby, an air flow that flows between the first air guide plate element 5A and the second air guide plate element 5B to be ejected out of the slot nozzle 6, forms a laminar air flow and particularly a laminar air cushion 8 that continues to flow laminarly along the upper surface of the air guide plate member 5A and between this surface and the material web 7, i.e. the web transport plane 3. This air cushion 8 supports and holds the material web 7 in the area as it leaves the interior treatment chamber 1.1 of the heat treating apparatus 1 through the exit gap 2.

The structural unit 5 is particularly divided into an overpressure or positive pressure chamber 5.1 and an underpressure or negative pressure chamber 5.2. The air outlet slot nozzle 6 described above is connected to and receives air from the positive pressure chamber 5.1. On the other hand, the negative pressure chamber 5.2 is bounded on the outer side thereof by an outer wall 5.2A that extends substantially vertically and perpendicularly to the web transport plane 3. A plurality of return suction openings or holes 9 are provided through this outer wall 5.2A, so that the expanded air of the air cushion 8 exiting out of the gap 2 can be sucked through these return suction openings 9 into the negative pressure chamber 5.2.

The pressure difference between the two chambers 5.1 and 5.2 is established by a ventilator 11 (which may be any known type of blower, fan, air pump or the like) interposed between a suction air line 10 and a pressure air line 12, which are respectively connected to the negative pressure chamber 5.2 and the positive pressure chamber 5.1. Alternatively, instead of using such an air line 10, 12, the ventilator 11 may be provided directly in the dividing wall 5.2B between the two chambers 5.1 and 5.2. An air flow regulator 13 may be interposed in the pressure air line 12 or in the suction air line 10.

In any event, the arrangement of the negative pressure chamber 5.2, the suction air line 10, the ventilator 11, the pressure air line 12, the positive pressure chamber 5.1, and the slot nozzle 6 which directs the laminar air cushion 8 to flow through the gap 2 and then be sucked back into the return openings 9 to return into the negative pressure chamber 5.1, forms a substantially continuous closed recirculating air loop that is completely independent and separate from the treatment air or gas conditions within the interior treatment chamber 1.1 of the heat treating apparatus 1. This separate closed air circulation loop has no negative influence on the energy balance of the heat treating apparatus or process. To the contrary, the above described support of the material web 7 and effective closure or blockage of the gap 2, while also minimizing the size of the gap 2, significantly reduces the loss of the heated process air from the interior treatment chamber 1.1 out through the gap 2. It should be understood that all of the present teachings regarding the exit gap 2 apply similarly to the entrance gap 20 of the apparatus, which is schematically shown in FIG. 2.

The structural unit 5 is supported by suitable adjustable support means 14 (such as a threaded adjustable bolt or screw, or threaded spindle, or toggle lever arrangement, or the like, or any conventionally known adjustable support device), so that the height position of the structural unit 5 can be adjusted in the direction of the double headed arrow 15 relative to the web transport plane 3. In this manner, the optimum spacing of the gap 2 can be selected to achieve the optimal formation of the required air cushion 8 for properly supporting the material web 7, depending on the particular type and characterizing parameters of the specific material web 7. It is further possible to carry out a vertical adjustment of the lower part of the heat treating apparatus 1 itself, in the direction of the double-headed arrow 15.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In a heat treating apparatus for heat treating a material web, including a heat treating chamber enclosed in a housing, an entrance gap through which the material web can enter into said chamber, an exit gap through which the material web can exit from said chamber, and at least one gap covering device that is arranged adjacent to and bounding a selected one of said entrance gap and said exit gap above or below a material web plane along which the material web will extend through said selected gap, an improvement wherein said gap covering device comprises an air cushion generating structural unit that is substantially box-shaped, is arranged at least partially in said chamber, and extends along an entire width of said selected gap, wherein said air cushion generating structural unit comprises an air outlet slot nozzle that extends along said entire width of said selected gap and is configured, oriented and adapted to direct a laminar air flow at an acute angle toward said material web plane and then outwardly from said chamber through said selected gap, and wherein said air cushion generating structural unit further comprises a first air guide member having a first air guide surface that smoothly adjoins and extends from said air outlet slot nozzle toward said material web plane, has an outwardly curving contour which is convex toward said material web plane, faces said material web plane, defines a space between said first air guide surface and said material web plane which tapers in a direction outwardly from said chamber through said selected gap, bounds a respective edge of said selected gap facing said material web plane, and extends from inside said chamber to outside said chamber across a gap plane perpendicular to said material web plane at a location where said selected gap is narrowest.

2. The improvement in the heat treating apparatus according to claim 1, comprising two respective ones of said air cushion generating structural unit respectively arranged at and extending along said entrance gap and said exit gap.

3. The improvement in the heat treating apparatus according to claim 1, wherein said air cushion generating structural unit is arranged at a bottom of said selected gap below said material web plane.

4. The improvement in the heat treating apparatus according to claim 3, wherein said apparatus does not include an air blowing nozzle at a top of said selected gap above said material web plane, and further comprising an adjustable gap covering door arranged at said top of said selected gap and bounding a top edge of said selected gap above said material web plane.

5. The improvement in the heat treating apparatus according to claim 3, further comprising another one of said air cushion generating structural unit arranged at a top of said selected gap above said material web plane.

6. The improvement in the heat treating apparatus according to claim 1, wherein said air cushion generating structural unit is arranged at a top of said selected gap above said material web plane.

7. The improvement in the heat treating apparatus according to claim 1, wherein said air cushion generating structural unit is configured, positioned with respect to said chamber, and adapted so as to avoid all physical contact with the material web as the material web passes through said selected gap.

8. The improvement in the heat treating apparatus according to claim 1, expressly excluding any and all air nozzles that are adjacent to said selected gap and that are arranged and oriented to direct an air curtain perpendicularly against the material web.

9. The improvement in the heat treating apparatus according to claim 1, wherein said acute angle is not greater than 30°.

10. The improvement in the heat treating apparatus according to claim 1, wherein said first air guide surface is configured and arranged to direct the laminar air flow from said slot nozzle laminarly along said first air guide surface and smoothly tangentially to said material web plane, while forming of the laminar air flow an air cushion between said first air guide surface and said material web plane.

11. The improvement in the heat treating apparatus according to claim 1, wherein said first air guide surface further has a flat planar contour which adjoins said curving contour and extends therefrom outwardly across said gap plane and bounds said respective edge of said gap.

12. The improvement in the heat treating apparatus according to claim 1, wherein the entirety of said first air guide surface is a smooth surface, and there are no obstructions to the laminar air flow anywhere between said slot nozzle and said gap.

13. The improvement in the heat treating apparatus according to claim 1, wherein said air cushion generating structural unit further comprises a second air guide member, said first and second air guide members are respective curved metal sheet members, and said second air guide member partially overlaps said first air guide member with a spacing therebetween so as to form said slot nozzle therebetween.

14. The improvement in the heat treating apparatus according to claim 1, wherein said air cushion generating structural unit encloses a positive pressure chamber communicating with said slot nozzle, and a negative pressure chamber, which are separated from each other therein.

15. The improvement in the heat treating apparatus according to claim 14, wherein said air cushion generating structural unit further comprises an outer wall that partially encloses said negative pressure chamber and adjoins said first air guide member outside of said selected gap, and wherein said outer wall has suction holes therein communicating from an outside environment adjacent to said selected gap into said negative pressure chamber.

16. The improvement in the heat treating apparatus according to claim 14, wherein said air cushion generating structural unit further comprises a ventilator that is connected for air flow communication from said negative pressure chamber to said positive pressure chamber, and that is adapted to create a relatively positive air pressure in said positive pressure chamber and a relatively negative air pressure in said negative pressure chamber.

17. The improvement in the heat treating apparatus according to claim 16, wherein said air cushion generating structural unit further comprises an air flow regulating device connected in series with said ventilator between said negative pressure chamber and said positive pressure chamber.

18. The improvement in the heat treating apparatus according to claim 1, further comprising an adjusting means that connects said air cushion generating structural unit to said housing of said apparatus and that enables a vertical position of said air cushion generating structural unit relative to said housing to be adjusted.

19. The improvement in the heat treating apparatus according to claim 1, further comprising a gap covering component arranged on an opposite side of said material web plane from said first air guide surface of said air cushion generating structural unit so as to bound said selected gap therebetween, wherein at least one of said gap covering component and said air cushion generating structural unit is movably connected to said housing, so that a vertical position thereof and a height of said gap are adjustable.

20. In a method of heat treating a material web including transporting said material web through said entrance gap into said heat treating chamber of said heat treating apparatus according to claim 1, heat treating said material web in said chamber, and transporting said material web through said exit gap out of said chamber, an improvement comprising stably supporting and guiding said material web as said material web is transported through said selected one of said entrance gap and said exit gap by applying a supporting force onto said material web within said heat treating chamber in an area adjacent to and extending through said selected gap so as to hold said material web on said material web plane, which is a defined horizontal plane, along a prescribed distance inside of and outside of said selected gap.

21. The improvement in the method according to claim 20, wherein said applying of said supporting force onto said material web comprises generating said laminar air flow along said material web within said heat treating chamber adjacent to said selected gap and forming from said laminar air flow an air cushion between said material web and said first air guide surface that bounds said respective edge of said selected gap, and further comprising flowing said air cushion out of said heat treating chamber through said selected gap, expanding said air cushion outside of said heat treating chamber and outside of said gap to provide expanded air, and sucking at least a portion of said expanded air back into said heat treating apparatus.

22. The improvement in the method according to claim 21, wherein said sucking comprises sucking at least a portion of said expanded air in a substantially closed circulation loop which then further provides said generating of said laminar air flow.

23. The improvement in the method according to claim 20, wherein said generating of said laminar air flow comprises directing said laminar air flow from said slot nozzle toward said material web at an acute angle.

24. The improvement in the method according to claim 23, wherein said acute angle is not greater than 30°.

25. The improvement in the method according to claim 21, wherein said generating of said laminar air flow comprises directing said laminar air flow along said first air guide surface tangent and parallel to said material web plane of said material web.

26. The improvement in the method according to claim 21, wherein said generating of said laminar air flow is carried out so as to form said air cushion extending crosswise relative to a transport direction of said transporting of said material web and along an entire width of said material web.

27. The improvement in the method according to claim 21, further comprising adjusting at least one characterizing parameter of said air cushion in a continuous stepless manner.

28. The improvement in the method according to claim 21, further comprising adjusting a vertical thickness of said air cushion so as to minimize a vertical height of said selected gap.

29. The improvement in the method according to claim 21, wherein said generating of said laminar air flow and said forming of said air cushion are carried out so as to generate a reduced air pressure that applies a pulling force to pull said material web toward said laminar air flow, and said air cushion pushes against said material web and counterbalances said pulling force, so as to together establish said supporting force that holds said material web on said material web plane.

* * * * *

UNITED STATES PATENT AND TRADEMARK OFFICE

CERTIFICATE OF CORRECTION

PATENT NO. : 6,431,858 B1
DATED : August 13, 2002
INVENTOR(S) : Rutz

It is certified that error appears in the above-identified patent and that said Letters Patent is hereby corrected as shown below:

Column 12,
Line 19, before "wherein", replace "20," by -- 21, --.

Signed and Sealed this

Twenty-ninth Day of October, 2002

*Attest:*

*Attesting Officer*

JAMES E. ROGAN
*Director of the United States Patent and Trademark Office*